US005346015A

United States Patent [19]

Grundmann

[11] Patent Number: 5,346,015

[45] Date of Patent: Sep. 13, 1994

[54] METHOD OF STIMULATION OF A SUBTERRANEAN FORMATION

[75] Inventor: Steven R. Grundmann, Duncan, Okla.

[73] Assignee: Halliburton Company, Duncan, Okla.

[21] Appl. No.: 65,961

[22] Filed: May 24, 1993

[51] Int. Cl.[5] ..... E21B 43/263

[52] U.S. Cl. ..... 166/299; 166/308

[58] Field of Search ..... 166/299, 308, 63

[56] References Cited

U.S. PATENT DOCUMENTS

| | | | |
|---|---|---|---|
| 3,075,463 | 1/1963 | Eilers et al. . | |
| 3,616,857 | 11/1971 | Pitkethly et al. | 166/299 |
| 3,674,093 | 7/1972 | Reese | 166/299 |
| 3,727,690 | 4/1973 | Munson | 166/297 |
| 3,999,609 | 2/1976 | Field | 166/299 |
| 4,049,056 | 9/1977 | Godfrey | 166/299 |
| 4,360,062 | 12/1986 | Browning | 166/299 |
| 4,895,206 | 1/1990 | Price | 166/260 |
| 4,945,984 | 8/1990 | Price | 166/63 |

*Primary Examiner*—William P. Neuder
*Attorney, Agent, or Firm*—Robert A. Kent

[57] ABSTRACT

The present invention provides a method of widening or extending fractures in a subterranean formation which intersect a wellbore to enhance the flow of fluids from the formation. The enhancement is achieved by introducing an explosive gas comprising a gaseous oxidizer and a gaseous fuel and optionally a quantity of inert gas into at least one fracture intersecting the wellbore and then detonating the explosive gas. The detonation produces a pressure wave which passes down the length of the fracture. The pressure wave can cause the fracture to extend and can cause the face of the fracture to yield whereby rubble is produced within the fracture which can prop the fracture in an open position.

Identical application of the method can be used to rubblize a formation for solution mining of minerals of said formation.

17 Claims, No Drawings

METHOD OF STIMULATION OF A SUBTERRANEAN FORMATION

BACKGROUND OF THE INVENTION

1. Field Of The Invention

The present invention provides a method of opening and extending fractures in a subterranean formation surrounding a wellbore penetrating the formation. The invention is particularly useful in formations which are naturally fractured such as coal seams, shales and chalk formations.

2. Brief Description Of The Prior Art

In many types of wells penetrating subterranean formations a casing is placed in the borehole and the casing then is perforated to establish communication between the wellbore and the subterranean formation. The casing typically is cemented in place within the borehole. The formation of perforations in the casing preferably establishes communication through the casing and surrounding cement into the adjacent subterranean formation. It is often desirable to fracture the subterranean formation in contact with the perforations to thereby facilitate the flow of any hydrocarbons or other fluids present in the formation to the wellbore.

Various methods and apparatus have been used to effect perforation of a well casing and fracturing of a subterranean formation. Perforations have been produced mechanically such as by hydrojetting and through the use of explosive charges such as in jet perforating. Fracturing has been accomplished by introducing an aqueous or hydrocarbon liquid into the formation through the perforations at a rate and pressure sufficient to fracture the subterranean formation. In some instances, the fracturing fluid may include a propping agent to prop the created fracture open upon completion of the fracturing treatment. The propped fracture provides an open channel through which fluids may pass from the formation to the wellbore.

Fracturing also has been accomplished by the detonation of explosives within a portion of a wellbore or the ignition of a quantity of a combustible gas mixture confined within a wellbore which produces a high pressure wave that fractures the formation surrounding the wellbore. Combustible or explosive liquids also have been utilized to fracture a subterranean formation. In this instance, the liquid reactants are injected into a wellbore and into the adjacent porous portions of the formation after which the liquid reactants are detonated to produce fractures in the formation.

SUMMARY OF THE INVENTION

The present invention provides an improved method of producing and extending fractures in formations which exhibit non-linear elastic characteristics or in naturally fractured formations and an equivalent system of stimulation of formations which do not contain natural fractures. The method is accomplished, in part, by the introduction of a gaseous explosive comprising a gaseous fuel and an oxidizer and optionally an inert gas into fractures contained in a subterranean formation and igniting the explosive within the formation fractures. The detonation, energy of the explosive can be controlled by the quantity of inert gas present and the pressure of the gas at the time of detonation. The detonation results in sufficient pressure to open the fracture, extend the fracture and produce sufficient rubble to prop the fracture in an opened condition.

DESCRIPTION OF THE PREFERRED EMBODIMENT

The present invention has general application to wells for the extraction of any fluid from a subterranean formation as well as for solution mining wherein fluids are injected and thereafter recovered with dissolved minerals therein. The present invention is particularly applicable to the recovery of gas or petroleum from naturally fractured subterranean formations and formations which can be hydraulically fractured initially to create the fracture flow path for introduction of the gaseous explosive. The use of the present invention is particularly beneficial in shale, chalk and fractured coal-bearing formations.

In a typical application, a wellbore is drilled from the surface of the earth to a desired depth within a subterranean formation. Casing may be placed within the wellbore and cemented or otherwise bonded in place within the wellbore. If the casing extends the full depth of the wellbore to a desired zone, the casing may be perforated or slotted by well known conventional methods to effect communication between the wellbore and the formation.

If the casing does not extend the full depth of the wellbore, communication is established through the uncased zone without perforation or slotting. A packer or packers then may be set in the casing or wellbore to isolate a particular portion of the wellbore which is to be stimulated. The packer or packers may be any one of the various commercially available types.

A tubing string then can be placed within the casing and passed through the upper packer to reach an isolated zone in the wellbore which is to be stimulated. The explosive gas then is introduced into the formation from the wellbore, either through natural or artificially created fractures present therein. The explosive gas is comprised of a mixture of an oxidizer and a fuel. The mixture also may include an inert gas, such as for example nitrogen, to assist in control of the detonation rate and the gas mixture pressure level in the formation. Preferably, the oxidizer is oxygen gas or an oxygen containing gas such as air. The fuel preferably comprises methane, ethane, ethylene, propane or any of the various other low molecular weight hydrocarbons which have a sufficiently low vapor pressure to be a gas at the temperature and pressure at which the stimulation treatment is effected. Preferably the constituents of the explosive gas are admixed or combined immediately prior to introduction into the formation. This may be effected, for example, by injecting the oxidizer down the annulus created by the casing and tubing string and hydrocarbon fuel down through the tubing such that the gases combine in the vicinity of the fractures in the formation. Such a method of introduction minimizes the amount of explosive gas mixture present in the wellbore prior to introduction into the subterranean formation.

The explosive gas is introduced at a rate and pressure sufficient to ensure that the mixture enters the fractures in the formation intersecting the wellbore. The fractures may be either natural fractures existing in the formation to be treated such as those in a coal bed or faulted chalk formation or they may be artificially induced fractures produced by a previously performed hydraulic fracturing treatment using an aqueous or hydrocarbon fluid. Numerous methods of effecting hydraulic fracturing treatments are known to individuals skilled in the art and substantially any of such methods may be utilized to create fractures extending from the wellbore into the formation.

Previously, it was not believed that it would be possible to detonate a gas contained in the narrow confines of a fracture since it generally is not possible to detonate a gas at atmospheric pressure contained in tubing having a diameter below about two inches. However, the surprising discovery has been made that when an elevated pressure is applied to the gas it is possible to detonate a mixture of nitrogen, oxygen and propane in a tubing having a diameter of only 0.083 inches down the length of the tubing. This discovery permits the use of an elevated pressure explosive gas to create and extend fractures in subterranean formation. Surprisingly, detonation of the explosive gas can result in an increase in the width of a fracture by a factor of from about 3 to 6 to as much as about 12 times its initial width. Further, the detonation results in the formation of sufficient rubble or formation particulate that the fracture retains a substantial amount of its opened width through propping of the fracture by the rubble or particulate. The movement of the pressure wave down the length of the fracture as the gas detonates down the fracture also results in lengthening of the fracture by the pressure applied at the end of the fracture. The force generated by the detonation is such that the formation may permanently yield thereby reducing the closure stress placed upon the created fracture as a result of passage of the momentary high pressure wave through the formation.

The detonation of the explosive gas may be effected by any suitable conventional means such as an explosive charge connected by a wireline to the surface in the same manner as perforating charges are initiated, an exploding bridge wire, in some instances an electric spark, an electrically heated filament or even a blasting cap. Substantially any means of detonation may be utilized so long as it effects a detonation of the explosive gas in the fractures within the subterranean formation.

Energy levels generated by the detonation of the explosive gas in the formation can be varied by adjusting the oxidizer and fuel concentrations. Preferably, the oxidizer and fuel are utilized in approximately stoichiometric ratios. The ratio may be varied for the oxidizer to inert gas mixture in an amount of from about 15 to 100% and most preferably only from about 21 to 40%. The ratio may be varied from stoichiometric for the fuel from about 80 to 150% of stoichiometric. The minor change of from about 21% oxygen to about 25% oxygen in the mixture can result in an energy increase upon detonation of a fuel, such as propane, of about 18% which can translate into an ability to extend a fracture having a smaller width than otherwise might be possible. Generally, the quantity of explosive gas utilized will depend upon the size and length of the fracture or fractures that it is desired to produce. Generally a typical treatment will utilize from about 200,000 Standard Cubic Feet (SCF) of gas at atmospheric temperature and pressure to about 3,000,000 SCF. The ability to introduce the gaseous explosive into the fractures in the subterranean formation will permit explosive to penetrate up to several hundred feet from the wellbore and in some instances in excess of 1000 feet prior to detonation. Thus, results in a substantially greater fracture size than could be accomplished by detonation of an explosive merely within a wellbore.

In the particular application of solution mining, the method of the present invention can substantially increase the surface area of a subterranean mineral-bearing zone for contact with a solvent or extractant. In this instance a wellbore is drilled into the mineral-bearing formation and if no natural fractures exist a hydraulic fracturing treatment can be utilized to create fractures in the formation. The explosive gas mixture then is introduced into the fractures in the mineral-bearing zone and ignited as previously described. In this instance, the amount of explosive energy is determined to achieve the effect of maximum rubblization of the mineral-bearing zone and the oxidizer/fuel ratios are adjusted accordingly. Thereafter a suitable solvent or extractant for the mineral that is desired to be recovered can be introduced into the formation to contact the rubblized formation material to dissolve or extract the desired mineral from the formation. The mineral-laden solvent or extract then can be recovered from the formation and the mineral recovered from the solution mining fluid.

To further illustrate the present invention, but not by way of limitation, the following example is provided.

EXAMPLE

A well drilled for methane production from a coal seam is 2400 feet deep with 5½ inch casing down to 2250 feet and open hole below the casing. The 150 feet of open hole contains 60 net feet of coal. Tubing with an outside diameter of 2⅜ inch is placed in the well to a depth of 2240 feet. A tool on the end of the tubing contains nozzles for atomizing propane into the annular area and a collar to support a wireline conveyed detonator. The detonator is designed such that 10 feet below the tubing is an electric detonator and explosive booster pellet. The detonator is placed down the tubing on the wireline until it is supported by the collar in the tool at the bottom of the tubing.

The well then is fractured in a conventional manner with a foam fracturing fluid containing fluid loss additives. The foam is pumped down the annulus at a rate of 60 barrels per minute. This rate is expected to create a fracture width of approximately 0.6 inches. A total of 600 barrels of foam are injected to initiate the fracture and control fluid loss. Then, the foam injection down the annulus is replaced with a mixture of 25% oxygen and 75% nitrogen. Propane is injected into the tubing at a rate of 50 gallons per minute such that the propane and the nitrogen/oxygen mixture reach the depth of 2240 feet at approximately the same time. Although the propane is introduced as a liquid in the tubing, it flashes to a gas when sprayed into the bottom of the casing. Total injection rate of propane, oxygen and nitrogen is equivalent to 60 barrels per minute at bottom hole treating pressure and temperature. The lower viscosity of the gaseous mixture will allow the fracture width to close to approximately 0.25 inches. A total of 1800 barrels of the explosive mixture is injected before displacement begins. This volume is expected to extend the fracture and explosive mixture a distance greater than 1500 feet from the wellbore. Nitrogen is used to displace the nitrogen/oxygen mixture and water is used to displace the propane. The displacement is timed such that both the propane .and nitrogen/oxygen mixture is displaced at approximately the same time. Once the fuel in the tubing and oxidizer in the annulus are displaced, all injection stops.

When the displacement is 95% complete, the detonator is activated by electrical signal down the wireline. The detonation moves from the wellbore and out into the fractures. The pressure is calculated to increase between 25 and 40 times the original fracturing pressure. Velocity of the detonation wave will exceed 6000 feet per second. The fracture may open to a width of as much as 2.5 inches which would yield the formation. Rubble generated from the pressure wave will fall down the fracture, propping it open.

The well then is shut-in for a period of time to allow unburned propane to adsorb onto the coal and the heat to dissipate. Initial flowback will be at a slow rate while testing the oxygen concentration for safety.

The resulting fracture may be propped to a width greater than 0.5 inches. The shock wave which travels through the formation is at an angle to the hydraulic fracture. Tests have shown that this shock wave will reflect from existing natural fractures. This reflection causes a compression wave to become a tensile wave and allows these fractures to interconnect with the wellbore. It is this phenomenon which makes this treatment especially effective in formations which contain natural fractures.

A total of 1500 gallons of propane are injected. Combined with oxygen, this has the explosive energy of 27,800 pounds of conventional explosives.

While the foregoing invention has been described with regard to that which is considered to be the preferred embodiment thereof, it will be understood by those skilled in the art that changes or other modifications may be made in the foregoing method and apparatus without departing from the spirit and scope of the invention as set forth in the appended claims.

What is claimed is:

1. A method of treating a subterranean formation to extend or widen fractures intersecting a wellbore in said formation to facilitate the flow of fluids from the formation into the fracture comprising:

introducing an explosive gas comprising a gaseous oxidizer and a gaseous fuel into a fracture intersecting a wellbore penetrating said subterranean formation; and igniting said explosive gas within said fracture whereby the detonation of said gas produces a high pressure wave within said fracture which results in the expansion of said fracture in said formation whereby the subsequent flow of fluids to said wellbore is enhanced.

2. The method of claim 1 wherein said gaseous oxidizer comprises an oxygen-containing gas.

3. The method of claim 1 wherein said fuel comprises at least one member selected from the group of methane, ethane, ethylene and propane.

4. The method of claim 1 wherein said explosive gas includes a quantity of an inert gas to control the detonation energy of the explosive gas.

5. The method of claim 1 wherein the width of said fracture is increased by a factor of at least about 3 by detonation of said explosive gas in said fracture.

6. The method of claim 1 wherein said fractures in said formation intersecting said wellbore are produced by a hydraulic fracturing treatment prior to introduction of said explosive gas into said wellbore.

7. A method of propping a fracture in a subterranean formation intersecting a wellbore penetrating said formation comprising:

introducing an explosive gas comprising a gaseous oxidizer and a gaseous fuel into a fracture in said formation;

igniting said explosive gas within said fracture to produce a momentary high pressure wave; and transmitting said pressure wave to said formation through a face of said fracture whereby said fracture face is caused to produce rubble that props said fracture in an open condition.

8. The method of claim 7 wherein said gaseous oxidizer comprises an oxygen-containing gas.

9. The method of claim 7 wherein said fuel comprises at least one member selected from the group of methane, ethane, ethylene and propane.

10. The method of claim 7 wherein said explosive gas includes a quantity of an inert gas to control the detonation energy of the explosive gas.

11. The method of claim 7 defined further to include the preliminary steps of:

drilling a wellbore into a subterranean formation;

inducing at least one fracture in said formation from said wellbore by means of injection of a hydraulic fracturing fluid.

12. The method of claim 11 defined further to include the steps of:

introducing a solution mining solvent or extractant into said wellbore and into said rubble containing fracture after ignition of said explosive gas to extract at least a portion of a desired mineral from the subterranean formation, and recovering at least a portion of said mineralcontaining solvent or extractant from said subterranean formation

13. A method of extending fractures in a subterranean formation intersecting a wellbore penetrating said formation to enhance the flow of fluids from said formation to said wellbore comprising:

introducing an explosive gas comprising an admixture of a gaseous oxidizer and a gaseous fuel into said wellbore at a rate and pressure sufficient to cause said explosive gas to enter at least one of said fractures intersecting said wellbore and to flow a substantial distance therein within said formation;

introducing an ignition source for said explosive gas into said wellbore and positioning said ignition source in an area within said wellbore adjacent said fracture which said explosive gas has entered;

igniting said explosive gas with said ignition source whereby said explosive gas with said ignition source detonates to produce a high pressure wave that passes down the length of said fracture as said explosive gas detonates, said high pressure wave producing an extension of said fracture upon contacting said formation at the end of said fracture.

14. The method of claim 11 wherein said gaseous oxidizer comprises an oxygen-containing gas.

15. The method of claim 11 wherein said fuel comprises at least one member selected from the group of methane, ethane, ethylene and propane.

16. The method of claim 11 wherein said explosive gas includes a quantity of an inert gas to control the detonation energy of the explosive gas.

17. The method of claim 11 wherein said ignition source is introduced into said wellbore on a wireline.

* * * * *